United States Patent [19]

Neumann et al.

[11] Patent Number: 4,789,382

[45] Date of Patent: Dec. 6, 1988

[54] BENZOPHENONE ETHER ESTERS AND USE THEREOF TO IMPROVE THE LIGHT FASTNESS OF POLYESTER DYEINGS

[75] Inventors: Peter Neumann, Wiesloch; Dieter Wegerle, Mannheim; Reinhold Krallmann, Weisenheim, all of Fed. Rep. of Germany

[73] Assignee: BASF Aktiengesellschaft, Rheinland-Pfalz, Fed. Rep. of Germany

[21] Appl. No.: 72,032

[22] Filed: Jul. 10, 1987

[30] Foreign Application Priority Data

Jul. 26, 1986 [DE] Fed. Rep. of Germany ..... 3625355

[51] Int. Cl.[4] ..... C07C 69/92; C07D 213/79; C07D 307/68; D06P 5/02

[52] U.S. Cl. ..... 8/442; 8/490; 8/583; 8/607; 8/610; 8/922; 560/103; 560/105; 560/107; 560/111

[58] Field of Search ..... 8/442, 607, 490, 583; 560/103, 105, 107

[56] References Cited

U.S. PATENT DOCUMENTS

| | | | |
|---|---|---|---|
| T970,001 | 5/1978 | Zannucci et al. | 8/539 |
| 3,644,485 | 2/1972 | Lappin et al. | 536/68 |
| 3,676,471 | 7/1972 | Eggensperger | 524/291 |
| 4,132,523 | 1/1979 | Ong | 8/444 |
| 4,355,080 | 10/1982 | Zannucci | 428/522 |

FOREIGN PATENT DOCUMENTS

| | | |
|---|---|---|
| 48-026841 | 8/1971 | Japan . |
| 56-159372 | 12/1981 | Japan . |
| 61-028088 | 2/1986 | Japan . |
| 852977 | 11/1960 | United Kingdom . |

*Primary Examiner*—A. Lionel Clingman
*Attorney, Agent, or Firm*—Oblon, Fisher, Spivak, McClelland & Maier

[57] ABSTRACT

Textile polyester material is dyed with disperse dyes in the presence of specific benzophenone derivatives, some of which are novel, to improve the light fastness.

6 Claims, No Drawings

BENZOPHENONE ETHER ESTERS AND USE THEREOF TO IMPROVE THE LIGHT FASTNESS OF POLYESTER DYEINGS

The present invention relates to novel benzophenone ether esters, to a process for dyeing textile polyester material with disperse dyes using benzophenone ether esters to improve the light fastness, and to the use of these benzophenone derivatives in the dyeing of textile polyester material.

German Published Application DAS No. 1,156,760 discloses for example a process for improving the light fastness of polyester dyeings by treating the fibers in a boiling aqueous dyebath which, in addition to the dye, also contains an alkyl ether of 2,2',4,4'-tetrahydroxybenzophenone. In this process, the benzophenone derivative goes onto the fiber together with the dye. The fiber thus dyed, on exposure in an irradiation apparatus (eg. a Xenotest or fade-ometer), has an improved light fastness compared with a fiber dyed without the tetrahydroxybenzophenone derivative.

However, the compounds described in said German Published Application DAS No. 1,156,760 have a number of disadvantages, viz. owing to their self-color they cause a shift in hue in particular in the case of brilliant dyeings and have a certain dulling effect on the dyeing; their affinity for the textile structures is not high enough, so that the dyehouse wastewater is polluted with organic compounds; and the compounds mentioned tend to sublime in the course of the thermal aftertreatment customarily carried out following the dyeing process.

U.S. Pat. No. 3,676,471 discloses that 2,4-dihydroxybenzophenone derivatives can be used as light stabilizers for plastics and polymers such as, for example, polypropylene, polyvinyl chloride, polyesters or nylons. It was not obvious from this to use such compounds in a system consisting of dyes and textile polyester material for stabilizing the dyes.

It is an object of the present invention to provide a substance for improving the light fastness of dyeings with disperse dyes on polyester which readily exhausts on polyester, has a substantial resistance to sublimation and has little if any impairing effect on the dyeings, in particular in respect of their brilliance.

We have found that this object is achieved according to the invention with a process for dyeing textile polyester material with disperse dyes in the presence of a benzophenone derivative to improve the light fastness, which comprises adding to the dyebath a benzophenone derivative of the formula I

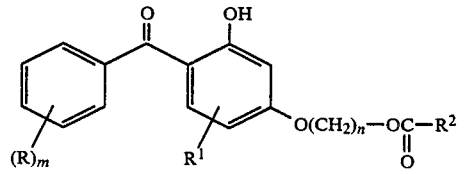

(I)

where

R is hydrogen, alkyl of 1 to 4 carbon atoms, cyano, fluorine, chlorine, bromine or trifluoromethyl, $R^1$ is hydrogen or alkyl of 1 to 6 carbon atoms, m is 1 or 2, n is 2, 3 or 4 and $R^2$ is alkyl of 1 to 12 carbon atoms, which may be substituted by hydroxy or $C_1$–$C_4$-alkoxy, or is cycloalkyl of 3 to 6 carbon atoms in the ring or a radical from the group consisting of the formulae

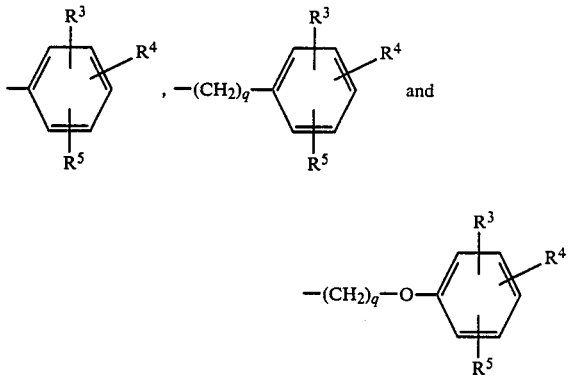

where $R^3$, $R^4$ and $R^5$ are each hydrogen, alkyl or alkoxy of 1 to 4 carbon atoms, or one or two of $R^3$, $R^4$ and $R^5$ is or are fluorine, chlorine, bromine, cyano or trifluoromethyl, one of $R^3$, $R^4$ and $R^5$ is phenyl or phenoxy and q is 1, 2, 3 4, or where $R^2$ is a substituted or unsubstituted 5- or 6-membered unsaturated heterocyclic ring, and using a benzophenone derivative of the formula I to improve the light fastness of dyed textile polyester material.

Preference is given to the benzophenone derivatives of the following formula II

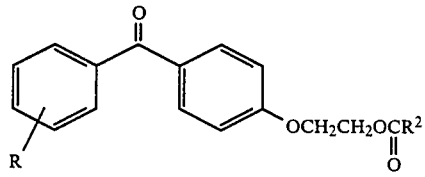

(II)

where R is hydrogen, methyl, fluorine, chlorine or bromine and $R^2$ is alkyl of 1 to 4 carbon atoms, cyclohexyl or a radical from the group.

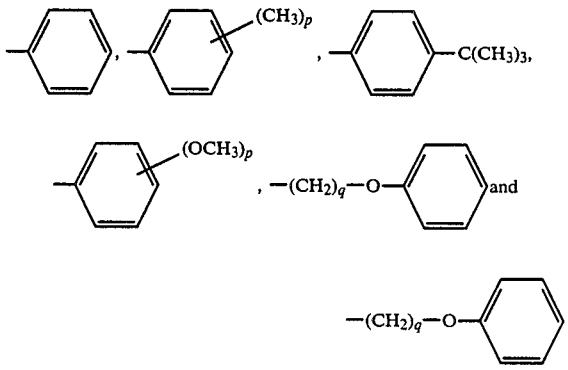

where p and q are each 1 or 2.

Of the compounds of formulae I and II, some are known and some have hitherto not been described. The present invention therefore also provides the novel benzophenone derivatives of the formula III

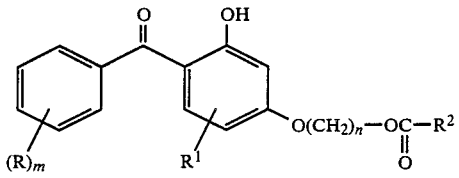

(III)

where R is hydrogen, alkyl of 1 to 4 carbon atoms, cyano, fluorine, chlorine, bromine or trifluoromethyl, $R^1$ is hydrogen or alkyl of 1 to 6 carbon atoms, m is 1 or 2, n is 2, 3 or 4 and $R^2$ is hydroxyl- or $C_1$–$C_4$-alkoxy-substituted alkyl of 1 to 4 carbon atoms or a radical from the group

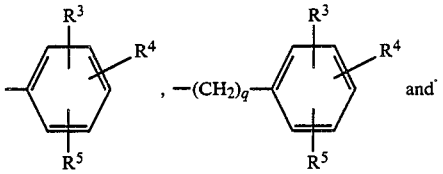

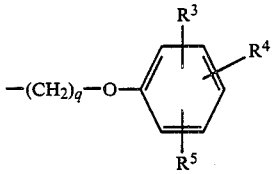

where $R^3$, $R^4$ and $R^5$ are each hydrogen, alkyl or alkoxy of 1 to 4 carbon atoms, or one or two of $R^3$, $R^4$ and $R^5$ is or are fluorine, chlorine, bromine, cyano or trifluoromethyl and q is 1, 2, 3 or 4, subject to the restriction that not less than one of $R^3$, $R^4$ and $R^5$ must be different from hydrogen, or where $R^2$ is a substituted or unsubstituted 5- or 6-membered unsaturated heterocyclic ring.

Of the compounds of the formula III, preference is given to those in which R is hydrogen, methyl, fluorine, chlorine or bromine, m is 1, $R^1$ is hydrogen and n is 2.

Particular preference is given to compounds of the formula III in which R is hydrogen, methyl, fluorine, chlorine or bromine, m is 1, $R^1$ is hydrogen and $R^2$ is a radical from the group

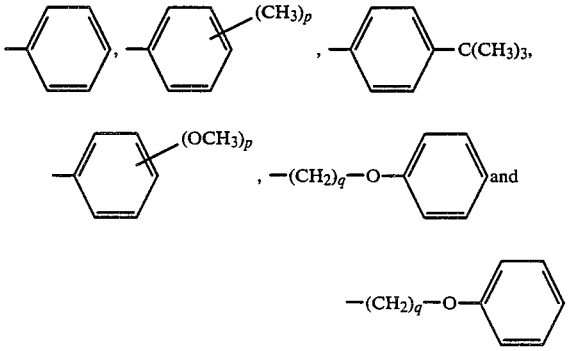

where p and q are each 1 or 2, except that $R^2$ cannot be phenyl if R is hydrogen.

Suitable alkyls R and $R^1$ are for example methyl, ethyl, propyl, n-butyl or tert.-butyl. Preferred meanings for R and $R^1$ are H and methyl.

$R^2$ in the formula I is for example:

$C_1$–$C_{12}$-alkyl, such as methyl, ethyl, n-propyl, isopropyl, n-butyl, isobutyl, sec.-butyl, tert.-butyl, n-pentyl, 3-methylbutyl, 1-ethylpropyl, 1,1-dimethylpropyl, 2,2-dimethylpropyl, n-hexyl, n-heptyl, 1-ethylpentyl, n-octyl, 2,4,4-trimethylpentyl, n-nonyl, n-decyl, n-undecyl, 4-dodecyl, hydroxymethyl, hydroxyethyl, 2-hydroxypropyl, 2-hydroxy-2-methylpropyl, 3-hydroxy-2-methylpropyl, 2-hydroxybutyl, methoxymethyl, methoxyethyl;

cycloalkyl, such as cyclopropyl, cyclobutyl, cyclopentyl or cyclohexyl;

In the case of

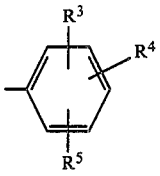

for example phenyl, 2-, 3- or 4-methylphenyl, 2-, 3- or 4-ethylphenyl, 2-, 3- or 4-n- or i-propylphenyl, 2-, 3- or 4-n- or tert.-butylphenyl, 2,3-dimethylphenyl, 2,4-dimethylphenyl, 2,5-dimethylphenyl, 2,6-dimethylphenyl, 3,4-dimethylphenyl, 3,5-dimethylphenyl, 2,4,6-trimethylphenyl, 2,4-dimethyl-6-tert.-butylphenyl, 2-, 3- or 4-chlorophenyl, 2-, 3- or 4-bromophenyl, 2,4-dichlorophenyl, 2,5-dichlorophenyl, 2,6-dichlorophenyl, 3,5-dichlorophenyl, 2-, 3- or 4-methoxyphenyl, 2,3-dimethoxyphenyl, 2,4-dimethoxyphenyl, 2,6-dimethoxyphenyl, 3,4-dimethoxyphenyl, 3,5-dimethoxyphenyl, 2-ethoxyphenyl, 4-ethoxyphenyl, 2,3,4-trimethoxyphenyl, 3,4,5-trimethoxyphenyl, 4-biphenyl, 4-phenoxyphenyl;

in the case of

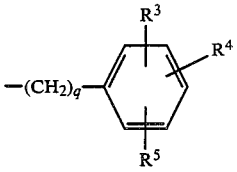

for example benzyl, 2- or 3- or 4-methylbenzyl, 4-ethylbenzyl, 4-isopropylbenzyl, 4-tert.-butylbenzyl, 2- or 3- or 4-chlorobenzyl, 2- or 3- or 4-bromobenzyl, 2- or 3- or 4-methoxybenzyl, 2- or 3- or 4-ethoxybenzyl, 3,4-dimethoxybenzyl, 3,5-dimethoxybenzyl, 3,4,5-trimethoxybenzyl, 2-phenylethyl, 3-phenylpropyl, 4-phenylbutyl;

in the case of

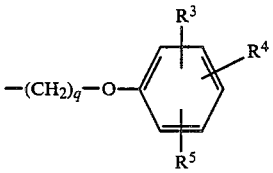

for example phenoxymethyl, 2-, 3- or 4-methylphenoxymethyl, 2-, 3- or 4-ethylphenoxymethyl, 4-isopropylphenoxymethyl, 4-n-butylphenoxymethyl, 4-tert.-butylphenoxymethyl, 2,3-dimethylphenoxymethyl, 2,4-dimethylphenoxymethyl, 2,5-dimethylphenoxymethyl, 3,5-dimethylphenoxymethyl, 3,4-dimethylphenoxymethyl, 2-methyl-4-tert.-butylphenoxymethyl, 3,4,5-trimethoxyphenoxymethyl, 2,4,6-trimethylphenoxymethyl, 2,6-dimethyl-4-tert.-butylphenoxymethyl, 2-, 3- or 4-chlorophenoxymethyl, 2-, 3- or 4-bromophenoxymethyl, 2-, 3- or 4-methoxyphenoxymethyl, 4-ethoxyphenoxymethyl, 2-methyl-4-chlorophenoxymethyl, 2-phenoxyethyl, 4-phenoxybutyl;

in the case of a heterocyclic ring, for example fur-2-yl, fur-3-yl, 2,5-dimethylfur-3-yl, thien-2-yl, thien-3-yl, pyrid-2-yl, pyrid-3-yl, pyrid-4-yl, or 2-chloropyrid-3-yl.

The preparation of the novel compounds of the formula (III) is effected in a conventional manner by reacting an alcohol of the formula (IV)

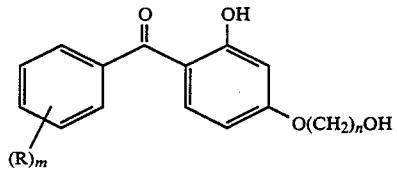

(IV)

where R, m and n have the meanings specified for R, m and n in the formula (III) with a carboxylic acid $R^2COOH$ where $R^2$ has the meanings specified for $R^2$ in the formula (III), in an inert solvent, in particular toluene or xylene, in the presence of an acid catalyst, in particular sulfuric acid, p-toluenesulfonic acid or a strongly acidic ion exchanger, under reflux, and working up in a conventional manner.

The process according to the invention is used to dye textile materials made of polyesters, in particular polyethylene terephthalates, such as polyethylene glycol terephthalate, in a conventional manner. Suitable textile materials are in particular structures such as fibers, filaments, flocks, films, wovens and knits. They can be dyed with the customary disperse dyes belonging to the known dye classes, eg. azo, anthraquinone, methine, quinophthalone or coumarin dyes, in a conventional manner, eg. by the high temperature process, by thermal soling, or by means of a carrier, as revealed for example in Ratgeber, Farben und Ausrusten von Polyesterfasern und Polyesterfasermischungen, issued 1974 by BASF Aktiengesellschaft. In the process according to the invention, the benzophenone derivative is added to the dyebath in a finely divided form, if desired in the form of a pulverulent or liquid formulation, in an amount of from 0.1 to 10, preferably from 0.3 to 5, % by weight on weight of fiber.

The dyeings obtained using the process according to the invention, compared with those obtained without the presence of a benzophenone derivative, differ little if at all therefrom in hue but have a markedly improved light fastness which can even meet the higher requirements of, for example, the automotive industry in respect of seat covers and the like.

Particular advantages over known benzophenone derivatives as described in German Published Application DAS No. 1,156,760 are that the compounds to be used according to the invention have significantly less self-color and hence have virtually no effect on the hue of dyeings. While for example in the case of 2,2'-dihydroxy-4,4'-dimethoxybenzophenone dyebath exhaustion is about 75%, the exhaustion reached by the compounds used according to the invention is of the order of 85–95%. With the known compounds the sublimation loss (30 seconds at 190° C.) is 20–25%, based on the exhausted substance, while with the compounds to be used according to the invention it is below 10%.

The parts in the Examples are by weight, and in Examples 1 to 13 R and $R^1$ are each always hydrogen.

EXAMPLE 1

A mixture of 27.6 g of 2-hydroxy-4-(β-hydroxyethoxy)-benzophenone, 150 ml of toluene, 45.6 g of 4-methoxybenzoic acid and 2 drops of concentrated sulfuric acid is heated at the boil for 11 hours under a water separator. After cooling down to room temperature, the mixture is diluted with petroleum ether, and the resulting precipitate is filtered off with suction and washed with a little methanol. The filtercake is stirred with 200 ml of 5% strength sodium carbonate solution for 1 hour, filtered off with suction, washed with water and recrystallized from isopropanol. This gives 28.8 g of the compound of the formula I where

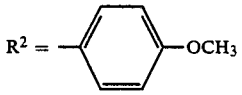

having a melting point of 107°–109° C.

| | C | H | O |
|---|---|---|---|
| Calculated | 70.4 | 5.14 | 24.46 |
| Found | 69.9 | 5.4 | 24.2 |

EXAMPLE 2

A mixture of 25.8 g of 2-hydroxy-4-(β-hydroxyethoxy)benzophenone, 60 ml of toluene, 15 g of phenylacetic acid and 2 drops of concentrated sulfuric acid is heated at the boil under a water separator for 5 hours. After addition of 10 ml of 5% sodium carbonate solution, the mixture is evaporated to dryness. The residue is recrystallized from isopropanol by adding 25 ml of 5% strength sodium carbonate solution as the isopropanol solution is cooling down. A further recrystallization from isopropanol and washing of the crystals with water gives 20 g of the compound of the formula I where

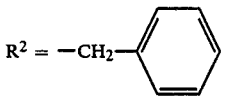

having a melting point of 93°–94° C.

| | C | H | O |
|---|---|---|---|
| Calculated | 73.39 | 5.36 | 21.25 |
| Found | 73.4 | 5.5 | 21.4 |

EXAMPLE 3

A mixture of 10.3 g of 2-hydroxy-4-(β-hydroxyethoxy), benzophenone, 50 ml of toluene, 9.1 g of 3,4-dimethoxy-benzoic acid and 1 g of p-toluenesulfonic acid is heated at the boil under a water separator for 13 hours. The mixture is then evaporated to dryness. The residue is stirred up with 150 ml of 5% strength sodium carbonate solution and is then recrystallized twice from isopropanol in the presence of bleaching earth. This gives 3.1 g of the compound of the formula I where

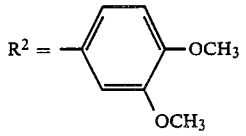

having a melting point 106°–108° C.

| | C | H | O |
|---|---|---|---|
| Calculated | 68.24 | 5.25 | 26.51 |
| Found | 68.0 | 5.4 | 26.2 |

EXAMPLE 4

A mixture of 25.8 g of 2-hydroxy-4-(β-hydroxyethoxy)-benzophenone, 150 ml of toluene, 16.3 g of 4-methylbenzoic acid and 2 g of p-toluenesulfonic acid is heated at the boil under a water separator for 24 hours. The mixture is then evaporated to dryness under reduced pressure. The residue is recrystallized from isopropanol by adding 25 ml of 5% strength sodium carbonate solution as the isopropanol solution is cooling down. A further recrystallization from isopropanol and washing of the crystals with water gives 9.5 g of the compound of the formula I where

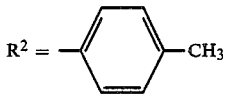

having a melting point of 135°–137° C.

| | C | H | O |
|---|---|---|---|
| Calculated | 73.39 | 5.36 | 21.25 |
| Found | 73.1 | 5.6 | 21.3 |

EXAMPLE 5

A mixture of 25.8 g of 2-hydroxy-4-(β-hydroxyethoxy)benzophenone, 150 ml of toluene, 43.5 g of 3-methylbenzoic acid and 2 g of p-toluenesulfonic acid is heated at the boil under a water separator for 16 hours. The mixture is then evaporated to dryness under reduced pressure. The residue is stirred up with 150 ml of 5% strength sodium carbonate solution and recrystallized from isopropanol in the presence of bleaching earth. This gives 16.2 g of the compound of the formula I where

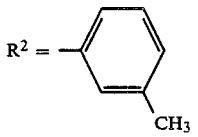

having a melting point of 92°–93° C.

| | C | H | O |
|---|---|---|---|
| Calculated | 73.39 | 5.36 | 21.25 |
| Found | 72.9 | 5.4 | 21.3 |

EXAMPLE 6

A mixture of 4.6 g of 2-hydroxy-4-(β-hydroxyethoxy)benzophenone, 50 ml of toluene, 8.53 g of 4-chlorophenylacetic acid and 2 drops of concentrated sulfuric acid is heated under a water separator for 4 hours. The mixture is then evaporated to dryness under reduced pressure. The residue is recrystallized from isopropanol. The crystals are recrystallized once more from isopropanol in the presence of active carbon together with further product isolated from the mother liquor. This gives 2.3 g of the compound of the formula I where

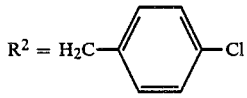

having a melting point of 92°–94° C.

| | C | H | O | Cl |
|---|---|---|---|---|
| Calculated | 67.44 | 4.66 | 19.43 | 8.63 |
| Found | 67.1 | 4.8 | 19.8 | 8.4 |

EXAMPLE 7

A mixture of 25.8 g of 2-hydroxy-4-(β-hydroxyethoxy)-benzophenone, 60 ml of toluene, 16.7 g of phenoxyacetic acid and 2 drops of concentrated sulfuric acid is heated at the boil under a water separator for 5 hours. Working up in the manner of Example 4 gives 24.5 g of the compound of the formula I where

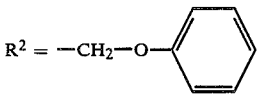

having a melting point of 108°–109° C.

| | C | H | O |
|---|---|---|---|
| Calculated | 70.40 | 5.14 | 24.46 |
| Found | 70.4 | 5.4 | 24.3 |

EXAMPLE 8

A mixture of 27.6 g of 2-hydroxy-4-(β-hydroxyethoxy)-benzophenone, 60 ml of toluene, 27 g of methoxyacetic acid and 2 drops of concentrated sulfuric acid is heated under a water separator for 6 hours. The mixture is evaporated to dryness under reduced pressure, the residue is taken up in methylene chloride, and the methylene chloride phase is washed twice with 5% strength sodium carbonate solution and with water. After drying over sodium sulfate the methylene chloride phase is removed under reduced pressure. This gives the compound of the formula I where $R^2=CH_2OCH_3$ in the form of an oil which requires no further purification for use in dyeing.

| | C | H | O |
|---|---|---|---|
| Calculated | 65.45 | 5.49 | 29.06 |
| Found | 65.5 | 5.9 | 28.6 |

EXAMPLE 9

A mixture of 25.8 g of 2-hydroxy-4-(β-hydroxyethoxy)-benzophenone, 60 ml of toluene, 14.9 g of 2-methylbenzoic acid and 3 drops of concentrated sulfuric acid is heated at the boil under a water separator for 10 hours. Working up in the manner of Example 4 gives 22.8 g of the compound of the formula I where

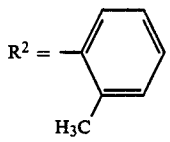

having a melting point of 91°-93° C.

| | C | H | O |
|---|---|---|---|
| Calculated | 73.39 | 5.36 | 21.25 |
| Found | 73.1 | 5.5 | 21.3 |

EXAMPLE 10

A mixture of 25.8 g of 2-hydroxy-4-(β-hydroxyethoxy)-benzophenone, 150 ml of toluene, 25.8 g of 2,4-homoveratric acid and 3 drops of concentrated sulfuric acid is heated at the boil under a water separator for 12 hours. The mixture is then evaporated to dryness under reduced pressure. The residue is stirred up with 150 ml of 5% strength sodium carbonate solution and recrystallized from ethanol in the presence of active carbon. This gives 20.1 g of the compound of the formula I where

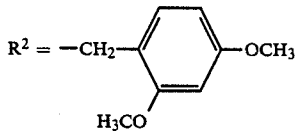

having a melting point of 102°-104° C.

| | C | H | O |
|---|---|---|---|
| Calculated | 68.8 | 5.54 | 25.66 |
| Found | 68.4 | 5.7 | 25.7 |

EXAMPLE 11

A mixture of 25.8 g of 2-hydroxy-4-(β-hydroxyethoxy)-benzophenone, 150 ml of toluene, 19.9 g of 4-methoxy-phenylacetic acid and 3 drops of concentrated sulfuric acid is heated under a water separator for 6 hours. Working up in the manner of Example 10 gives 9.2 g of the compound of the formula I where

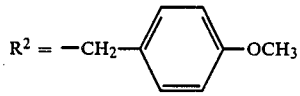

having a melting point of 81°-83° C.

| | C | H | O |
|---|---|---|---|
| Calculated | 70.99 | 5.46 | 23.62 |
| Found | 70.9 | 5.7 | 23.6 |

EXAMPLE 12

A mixture of 25.8 g of 2-hydroxy-4-(β-hydroxyethoxy)-benzophenone, 150 ml of toluene, 14.1 g of cyclohexane-carboxylic acid and 3 drops of concentrated sulfuric acid is heated under a water separator for 6 hours. Working up in the manner of Example 4 gives, after two recrystallizations from isopropanol/water in the presence of bleaching earth, 7.5 g of the compound of the formula I where

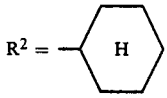

having a melting point of 60°-62° C.

| | C | H | O |
|---|---|---|---|
| Calculated | 71.72 | 6.57 | 21.71 |
| Found | 71.9 | 6.8 | 21.6 |

EXAMPLE 13

A mixture of 25.8 g of 2-hydroxy-4-(β-hydroxyethoxy)-benzophenone, 150 ml of toluene, 18 g of dihydrocinnamic acid and 3 drops of concentrated sulfuric acid is heated under a water separator for 6 hours. Working up in the manner of Example 10 gives 22.1 g of the compound of the formula I where

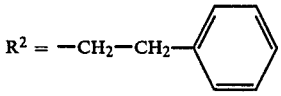

having a melting point of 75°-77° C.

| | C | H | O |
|---|---|---|---|
| Calculated | 73.83 | 5.68 | 20.49 |
| Found | 73.5 | 5.8 | 20.4 |

EXAMPLE 14

Example 2 is repeated using 13.6 g of 2-hydroxy-4-(β-hydroxyethoxy)-4'-methylbenzophenone and 7.5 g of phenylacetic acid. Recrystallization from ethanol in the presence of active carbon gives 12.5 g of the compound of the formula

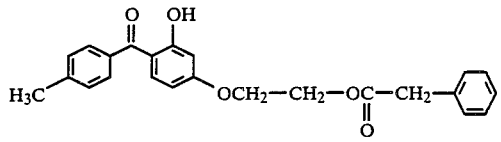

having a melting point of 99°-100° C.

| | C | H | O |
|---|---|---|---|
| Calculated | 73.83 | 5.68 | 20.49 |
| Found | 73.9 | 5.8 | 20.1 |

EXAMPLE 15

A mixture of 13.6 g of 2-hydroxy-4-(β-hydroxyethoxy)-4'-methylbenzophenone, 7.7 g of benzoic acid, 60 ml of toluene and 2 drops of concentrated sulfuric acid is heated at the boil under a water separator for 20 hours. After addition of 5 ml of 5% strength by weight sodium carbonate solution the mixture is evaporated to dryness, and the residue is recrystallized twice from ethanol to give 7.3 g of the compound of the formula

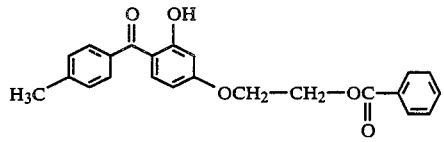

having a melting point of 70°-72° C.

| | C | H | O |
|---|---|---|---|
| Calculated | 73.59 | 5.10 | 21.31 |
| Found | 73.0 | 5.4 | 21.2 |

EXAMPLE 16

Example 14 is repeated using 8.35 g of phenoxyacetic acid to give 13.9 g of the compound of the formula

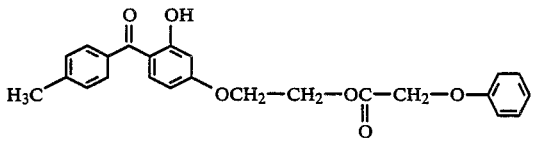

having a melting point of 95°-96° C.

| | C | H | O |
|---|---|---|---|
| Calculated | 70.93 | 5.46 | 23.62 |
| Found | 70.9 | 5.6 | 23.4 |

EXAMPLE 17

Example 14 is repeated using 29.25 g of 2-hydroxy-4-(β-hydroxyethoxy)-4'-chlorobenzophenone and 15 g of phenylacetic acid. Successive recrystallization from aqueous methanol (80%) in the presence of active carbon and cyclohexane gives 17.9 g of the compound of the formula

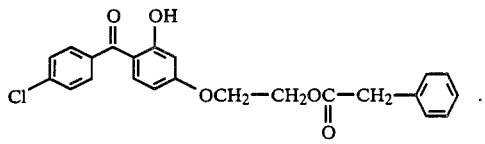

having a melting point of 80°-82° C.

| | C | H | O | Cl |
|---|---|---|---|---|
| Calculated | 67.24 | 4.66 | 19.47 | 8.63 |
| Found | 67.0 | 4.8 | 19.3 | 9.0 |

EXAMPLE 18

Example 14 is repeated using 29.25 g of 2-hydroxy-4-(β-hydroxyethoxy)-4'-chlorobenzophenone and 16.7 g of phenoxyacetic acid. Recrystallizing twice from isopropanol in the presence of active carbon gives 21 g of the compound of the formula

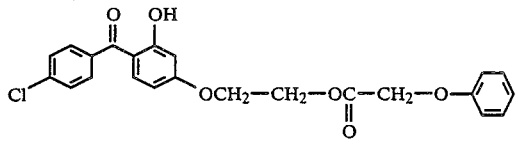

having a melting point of 94°-96° C.

| | C | H | O | Cl |
|---|---|---|---|---|
| Calculated | 64.72 | 4.45 | 22.49 | 8.31 |
| Found | 64.5 | 4.5 | 22.4 | 8.7 |

EXAMPLE 19

Example 14 is repeated using 29.25 g of 2-hydroxy-4-(β-hydroxyethoxy)-4'-chlorobenzophenone and 18.0 g of dihydrocinnamic acid. Successive crystallization from isopropanol in the presence of active carbon and cyclohexane/bleaching earth gives 16.5 g of the compound of the formula

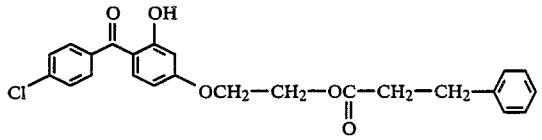

having a melting point of 65°-67° C.

| | C | H | O | Cl |
|---|---|---|---|---|
| Calculated | 67.85 | 4.98 | 18.83 | 8.34 |
| Found | 67.3 | 5.0 | 18.5 | 8.6 |

The starting compounds 2-hydroxy-4-(β-hydroxyethoxy)-4'-chlorobenzophenone and -4-methylbenzophenone are obtained from the corresponding 2,4-dihydroxy-4'-chlorobenzophenone and -4'-methylbenzophenone by conventional reaction with ethylene oxide or ethylene carbonate.

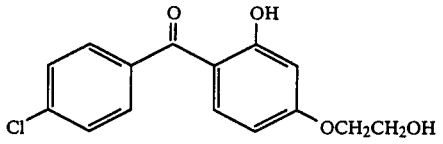

melting point 123-125° C.

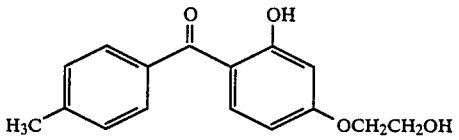

melting point 121-123° C.

APPLICATION EXAMPLE 1

100 parts of a polyester yarn are treated in a dye-bath which contains 1,500 parts of water, 0.6 part of a mixture of the finely divided dyes

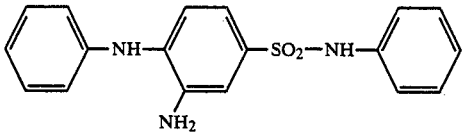

(0.30 part)

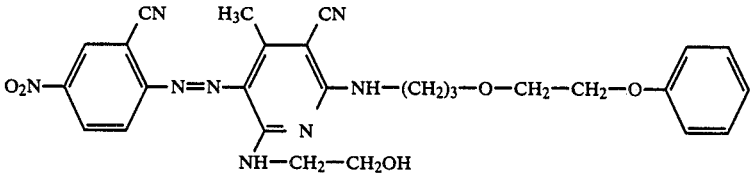

(0.06 part) II

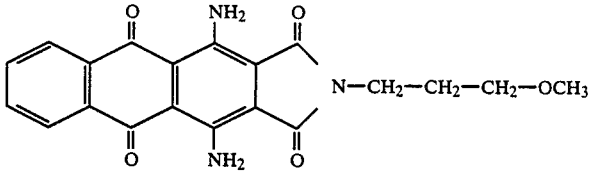

(0.24 part) III 1.8 parts of a dyeing assistant comprising a product obtained by addition of 50 moles of ethylene oxide onto 1 mole of sperm oil alcohol and subsequent sulfonation and 1.5 parts of the finely divided benzophenone compound of the formula

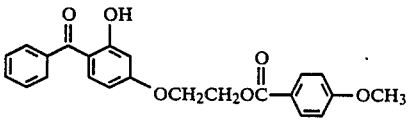

Starting at 60° C., the temperature is raised to 130° C. in the course of 20 minutes and dyeing is continued at that temperature for a further 90 minutes in an HT dyeing apparatus.

The result obtained is a brown dyeing which on exposure in a Xenotest under moist and hot conditions (for example 75° C., relative humidity 80%) is significantly light-faster than the same dyeing without the presence of the benzophenone compound.

APPLICATION EXAMPLE 2

100 parts of a polyester knit are treated in a dye-bath which contains 2,500 parts of water, 1.2 parts of a mixture of the finely divided dyes

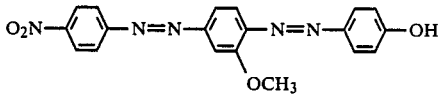

I (0.18 part)

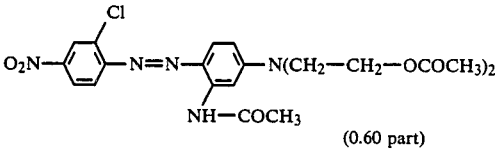

II (0.60 part)

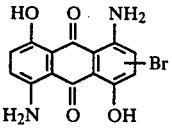

(0.42 part) III

I 5 parts of a carrier based on methyl salicylate and 2 parts of the finely divided benzophenone compound of the formula.

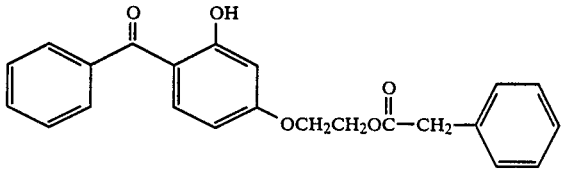

Dyeing is carried out at the boil for 90 minutes to give a reddish brown dyeing which on exposure in a fadeometer produces distinctly better results than the same dyeing without the benzophenone compound.

APPLICATION EXAMPLE 3

A polyester fabric is impregnated on a three-roll padmangle with a dyeing liquor which contains, in 1,000 parts, 25 parts of a mixture of finely divided dyes

I

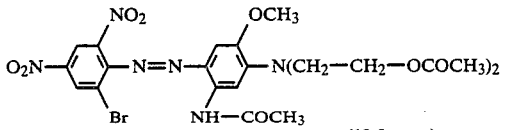

(12.5 parts)

II

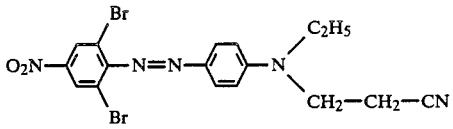

(10.0 parts)

III

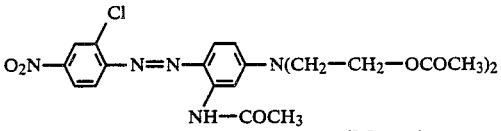

(2.5 parts)

20 parts of a 20% strength aqueous solution of a copolymer of acrylic acid and acrylamide, 25 parts of the finely divided benzophenone compound

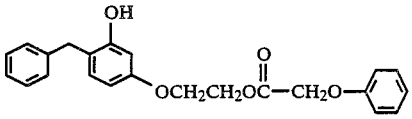

and 930 parts of water.

After impregnation to a wet pickup of 60%, the fabric is dried at 120° C. and thermosoled at 200° C. for 60 seconds.

The result obtained is a gray dyeing which has a significantly better light fastness than the same dyeing without the benzophenone compound.

APPLICATION EXAMPLE 4

Dyeing is carried out in the manner of Example 2 using the benzophenone compound of the formula

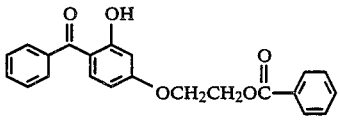

The result obtained is a reddish brown dyeing which on exposure in a fade-ometer gives significantly better results than the same dyeing without the benzophenone compound.

APPLICATION EXAMPLE 5

100 parts of a polyester knit are treated in a dyebath which contains 2,500 parts of water, 1.2 parts of a mixture of the finely divided dyes

I

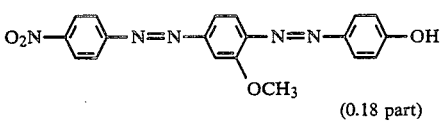

(0.18 part)

II

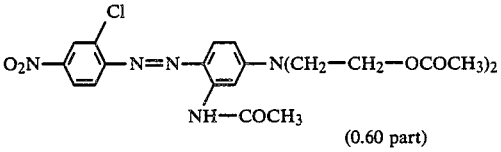

(0.60 part)

III

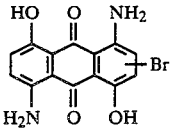

(0.42 part)

5 parts of a carrier based on methyl salicylate and 2 parts of the finely divided benzophenone compound of the formula

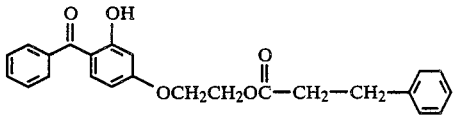

The dyeing is carried out at the boil for 90 minutes to give a reddish brown dyeing which on exposure in a fade-ometer gives significantly better results than the same dyeing without the benzophenone compound.

APPLICATION EXAMPLE 6

100 parts of a polyester yarn are treated in a dyebath which contains 1,500 parts of water, 0.6 part of a mixture of finely divided dyes

I

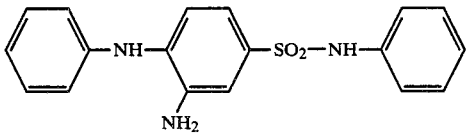

(0.30 part)

II

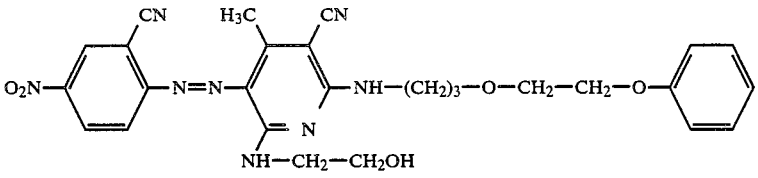

(0.06 part)

-continued

III

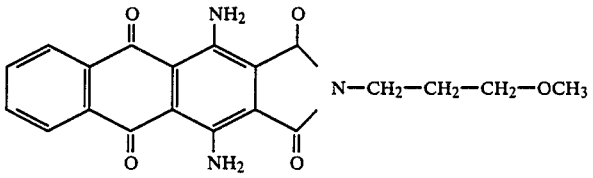

(0.24 part)

1.8 parts of a dyeing assistant comprising a product obtained by addition of 50 moles of ethylene oxide onto 1 mole of sperm oil alcohol and subsequent sulfonation and 1.5 parts of the finely divided benzophenone compound of the formula

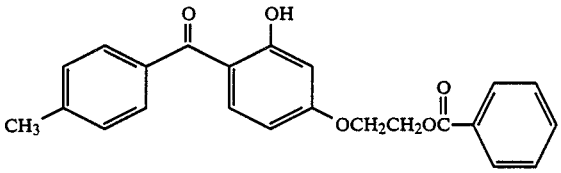

Starting at 60° C., the temperature is raised to 130° C. in the course of 20 minutes, and the dyeing is completed at that temperature in a high-temperature dyeing apparatus in the course of a further 90 minutes.

The result obtained is a brown dyeing which on exposure in a Xenotest under moist and hot conditions (temperature 75° C., relative humidity 80%) is significantly light-faster than the same dyeing without the benzophenone compound.

The benzophenone compound according to the invention which is used in this Example exhausts to over 90% onto the polyester fiber and exhibits only a small sublimation loss (190° C. for 30 sec) of 5–6%. In these properties it is significantly more favorable than the known 2,2'-dihydroxy-4,4'-dimethoxybenzophenone, the exhaustion of which is about 75% and the sublimation loss of which (190° C. for 30 sec) is 20–25% under the same dyeing conditions.

APPLICATION EXAMPLE 7

A polyester fabric is impregnated on a three-roll padmangle with a dyeing liquor which, in 1,000 parts, contains 25 parts of a mixture of the finely divided dyes

I

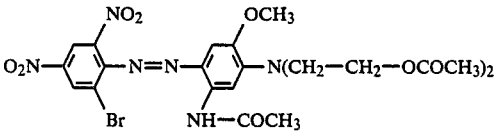

(12.5 parts)

-continued

II

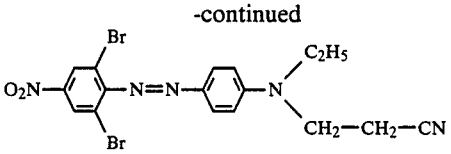

(10.0 parts)

III

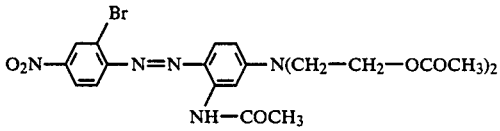

(2.5 parts)

20 parts of a 20% strength aqueous solution of a copolymer of acrylic acid and acrylamide, 25 parts of the finely divided benzophenone compound and 930 parts of

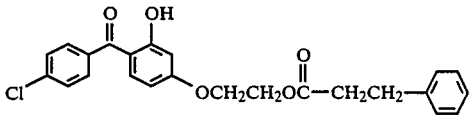

and 930 parts of water.

After impregnation to a wet pickup of 60%, the fabric is dried at 120° C. and thermosoled at 200° C. in the course of 60 seconds.

The result obtained is a gray dyeing which is significantly better in light fastness than the same dyeing without the benzophenone compound.

The benzophenone compound according to the invention which is used in this Example exhausts to 87–88% onto the polyester fiber and exhibits only a small sublimation loss (190° C. for 30 seconds) of below 5%. In these properties it is significantly more favorable than the known 2,2'-dihydroxy-4,4'-dimethoxybenzophenone, the exhaustion of which is about 75% and the sublimation loss of which is (190° C. for 30 sec.) is 20–25% under the same dyeing conditions.

APPLICATION EXAMPLE 8

100 parts of a polyester knit are treated in a dyebath which contains 2,500 parts of water, 1.2 parts of a mixture of the finely divided dyes

I

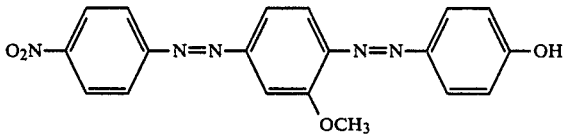

(1.2 parts)

-continued

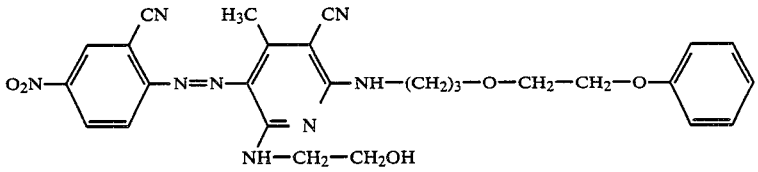

II (0.6 part)

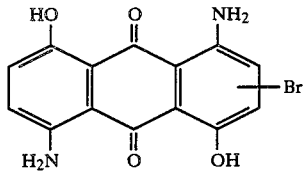

III (6.0 parts)

5 parts of a carrier based on methyl salicylate and 2 parts of the finely divided benzophenone compound of the formula

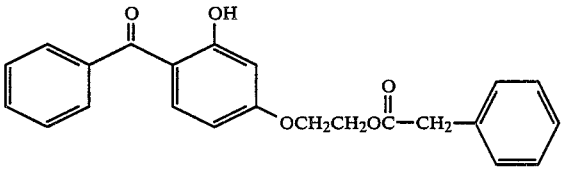

Dyeing is carried out at the boil for 90 minutes to give a black dyeing which on exposure in a fade-ometer gives significantly better results than the same dyeing without the benzophenone compound.

The benzophenone compound according to the invention used in this Example exhausts to about 87% onto the polyester fiber and exhibits only a small sublimation loss (190° C. for 30 seconds) of 4–5%. In these properties it is significantly more favorable than the known 2,2'-dihydroxy-4,4'-dimethoxybenzophenone, the exhaustion of which is about 75% and the sublimation loss of which (190° C. for 30 seconds) is 20–25% under the same dyeing conditions.

APPLICATION EXAMPLE 9

100 parts of a polyester yarn are treated in a dyebath which contains 1,500 parts of water, 0.6 part of a mixture of finely divided dyes

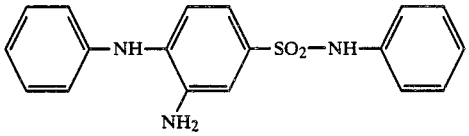

I (0.8 part)

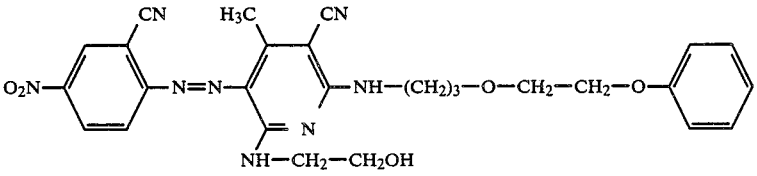

II (0.05 part)

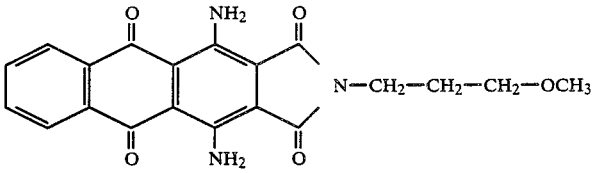

III (1.0 part)

1.8 parts of a dyeing assistant comprising a product obtained by addition of 50 moles of ethylene oxide onto 1 mole of sperm oil alcohol and subsequent sulfonation and 1.5 parts of the finely divided benzophenone compound of the formula

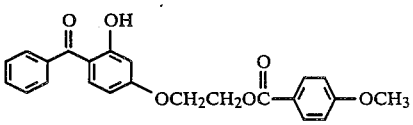

Starting at 60° C., the temperature is raised to 130° C. in the course of 20 minutes, and dyeing is completed at that temperature in an HT dyeing apparatus in the course of a further 90 minutes.

The result obtained is a green dyeing which on exposure in a Xenotest under moist and hot conditions (temperature 75° C., relative humidity 80%) is significantly lightfaster than the same dyeing without the benzophenone compound.

APPLICATION EXAMPLE 10

100 parts of a polyester yarn are treated in a dyebath which contains 1,500 parts of water, 0.6 part of a mixture of the finely divided dyes

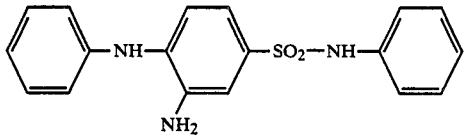

(0.6 part)

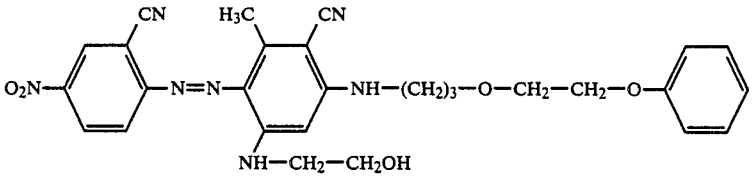

(0.36 part)

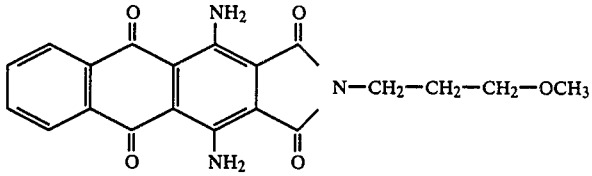

(0.8 part)

1.8 parts of a dyeing assistant comprising a product obtained by addition of 50 moles of ethylene oxide onto 1 mole of sperm oil alcohol and subsequent sulfonation and 1.5 parts of the finely divided benzophenone compound of the formula

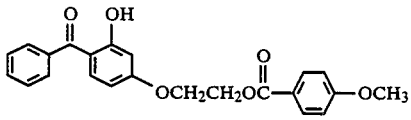

Starting at 60° C., the temperature is rasied to 130° C. in the course of 20 minutes, and dyeing is completed at that temperature in a high-temperature dyeing apparatus in the course of a further 90 minutes.

The result obtained is a violet dyeing which on exposure in a Xenotest under moist and hot conditions (temperature 75° C., relative humidity 80%) is significantly light-faster than the same dyeing without the benzophenone compound.

We claim:

1. A process for dyeing textile polyester material with disperse dyes in the presence of a benzophenone derivative to improve light fastness, which comprises adding to the dye bath a benzophenone derivative of the formula (II):

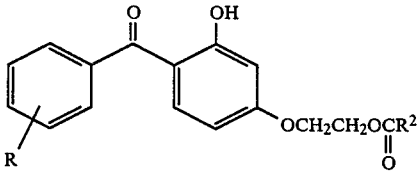

wherein R is hydrogen, $C_1$–$C_4$ alkyl, fluorine, chlorine or bromine; and $R^2$ is a radical selected from the group consisting of:

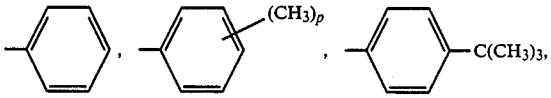

I

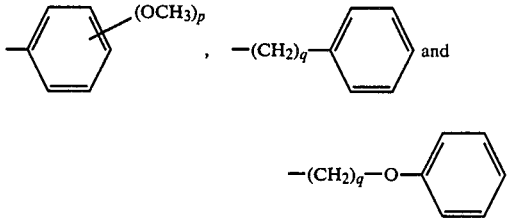

wherein p and q are each 1 or 2, in an amount of from about 0.1 to 10% by weight, based on the weight of the fiber.

2. The process of claim 1, wherein said textile polyester material is a material selected from the group consisting of fibers, filaments, flocks, films, wovens and knits.

3. The process of claim 1, wherein said benzophenone derivative is added to the dyebath in the amount of 0.3 to 5% by weight, based on the fiber weight.

4. The process of claim 1, wherein said $C_1$–$C_4$ alkyl group for R is selected from the group consisting of methyl, ethyl, propyl, n-butyl and tert-butyl.

5. A benzophenone derivative of the formula (III):

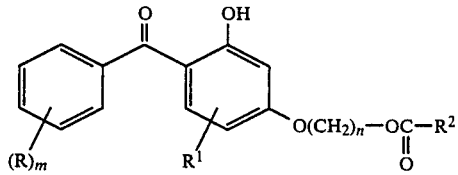

wherein R is hydrogen, $C_1$–$C_4$ alkyl, fluorine, chlorine or bromine; m is 1; n is 2; $R^1$ is hydrogen; and $R^2$ is a radical selected from the group consisting of:

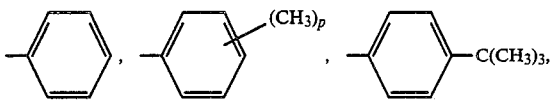

-continued

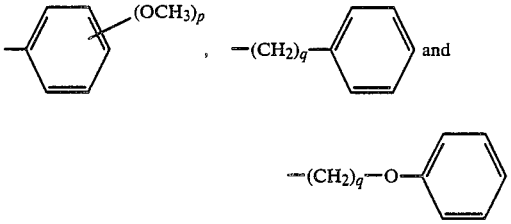

wherein p and q are each 1 or 2, with the proviso that $R^2$ is not phenyl, when R is hydrogen.

6. The benzophenone derivative of claim 5, wherein said $C_1$–$C_4$ alkyl group for R is selected from the group consisting of methyl, ethyl, propyl, n-butyl and tert-butyl.

* * * * *